US008008870B2

(12) United States Patent
Kimura

(10) Patent No.: US 8,008,870 B2
(45) Date of Patent: Aug. 30, 2011

(54) CONSTANT-CURRENT DRIVE CIRCUIT

(75) Inventor: Tarou Kimura, Tokyo (JP)

(73) Assignee: NEC Display Solutions, Ltd., Tokyo (JP)

( * ) Notice: Subject to any disclaimer, the term of this patent is extended or adjusted under 35 U.S.C. 154(b) by 1232 days.

(21) Appl. No.: 11/706,190

(22) Filed: Feb. 15, 2007

(65) Prior Publication Data

US 2008/0198884 A1 Aug. 21, 2008

(51) Int. Cl.
*H05B 37/02* (2006.01)

(52) U.S. Cl. ..... 315/307; 315/291; 315/294; 315/312; 363/21.09; 363/21.1

(58) Field of Classification Search ..... 315/291, 315/224, 307, 169.3, 129, 151, DIG. 4, 294, 315/312; 345/102; 363/21.09, 21.1, 21.11
See application file for complete search history.

(56) References Cited

U.S. PATENT DOCUMENTS 6,909,249 B2 * 6/2005 Otake ..... 315/291
7,145,295 B1 * 12/2006 Lee et al. ..... 315/291
7,202,608 B2 * 4/2007 Robinson et al. ..... 315/224
7,402,960 B2 * 7/2008 Kajita ..... 315/291
7,466,082 B1 * 12/2008 Snyder et al. ..... 315/307
2004/0251854 A1 * 12/2004 Matsuda et al. ..... 315/291
2007/0035538 A1 * 2/2007 Garcia et al. ..... 345/212

FOREIGN PATENT DOCUMENTS

JP 2000-214825 A 8/2000
WO WO 2004/057921 7/2004

* cited by examiner

*Primary Examiner* — Jacob Y Choi
*Assistant Examiner* — Ephrem Alemu
(74) *Attorney, Agent, or Firm* — Birch, Stewart, Kolasch & Birch, LLP

(57) ABSTRACT

A voltage supplied from a power supply is boosted by a boosting circuit unit to generate a direct-current voltage, and the pulse-shape direct-current voltage is applied to LED while a constant-voltage control unit controls the direct-current voltage. The operation of LED is controlled by a control unit and a PWM unit. When the current is passed through LED, the constant-voltage control unit obtains information on the current passed through LED from a potential difference between both ends of a resistor, and on-and-off control of the voltage applied to LED from the boosting circuit unit is performed at a high frequency based on the information. Therefore, the voltage applied to LED can be controlled to keep the current passed through LED constant.

6 Claims, 6 Drawing Sheets t0 ta tb
t1
t2
t a
b
c
VU
VL

CONSTANT-CURRENT DRIVE CIRCUIT

BACKGROUND OF THE INVENTION

1. Field of the Invention

The present invention relates to a constant-current drive circuit which causes a light emitting device such as LED (Light Emitting Diode) to emit light with target brightness.

2. Description of the Background Art

In order to utilize LEDs having RBG colors to display various colors, it is necessary that LEDs having the RGB colors stably emit the light with the similar brightness. In addition to a back light used in electronic instruments such as a portable telephone, the color display with LED comes into widespread use among various fields such as illumination for a speed meter of an automobile and a display device. There are various techniques of driving LED at constant current for the purpose of the stable light emission of LED. For example, Japanese Patent Application Laid-Open No. 2000-214825 proposes a technique of performing PWM (Pulse Width Modulation) control to stably drive LED having RGB colors.

In Japanese Patent Application Laid-Open No. 2000-214825, a constant voltage is applied to each of LEDS having the RGB colors, and a difference of forward drop voltage is adjusted in each LED by an adjusting resistor provided in each LED, which enables the stable light emission at constant current. The technique proposed in Japanese Patent Application Laid-Open No. 2000-214825 can sufficiently serve a relatively-small-scale circuit such as the portable telephone. However, in a large-scale circuit such as a large-scale display device in which high brightness is required by utilizing many LEDs as the back light, it is difficult that a fluctuation in forward voltage is individually adjusted by the adjusting resistor. Therefore, the brightness of LED cannot be kept uniform by the constant-current drive, which results in a problem that degradation of image quality such as unevenness of brightness is generated in the display.

In Japanese Patent Application Laid-Open No. 2000-214825, a drain of a switching FET is connected onto a cathode side of LED, a voltage generated by a D/D converter is applied to an anode side of LED, and a control unit applies a pulse voltage to a gate of the switching FET by PWM (Pulse Width Modulation) control to control a switching operation, which allows LED to be driven. That is, on-and off control of the pulse voltage is performed to control the lighting of LED by PWM. At this point, the control unit also controls the D/D converter.

However, in the method proposed in Japanese Patent Application Laid-Open No. 2000-214825, sometimes there is generated a problem when LED is lit on. Specifically, in lighting LED on from a state, in which LED is turned off while the voltage is not applied, even if the control unit controls to turn on the switching FET at the same time as start of the application of the constant voltage to LED, because the generation and application of the voltage is started at that moment by the D/D converter, the sufficient voltage is not obtained, or the voltage generated by the D/D converter is incorrectly controlled by an influence of a charge remaining between the control unit and the D/D converter. Therefore, from the viewpoint of waveform of the current passed through LED, although the control is performed such that the pulse waveform rises steeply from the turn-off to the turn-on of LED, actually a time lag is generated until the intended current is obtained, and sometimes rounding in which the current is gradually increased is generated in the current waveform. In this case, LED cannot emit the light with the originally intended brightness until a predetermined current is obtained.

The generation of the phenomenon does not become problematic, in the case of the relatively-small-scale circuit such as the portable telephone in which each one of LEDs having the RGB colors is utilized, or in the case where LED is utilized in the instrument in which high-speed operation is not required. However, the drawback that the brightness is changed according to the rise of the current becomes prominent, in the electronic instrument such as the display which is realized by connecting many LEDs in series or by utilizing a high-current drive type of high-brightness LED. Therefore, there is a problem that this method cannot be utilized for the display in which the high-speed operation is required, e.g., a moving image is displayed.

The phenomenon can be avoided when the current voltage is continuously applied to LED even if LED is turned off by the switching FET. However, in this case, an excessive inrush current is passed through LED once the switching FET is turned on, which results in a problem that components such as LED which constitute the circuit is possibly broken.

SUMMARY OF THE INVENTION

In view of the foregoing, an object of the invention is to provide a constant-current drive circuit which can always drive all LEDs at constant current while the PWM control is utilized.

A constant-current drive circuit according to one aspect of the invention which drives an element with a predetermined current value, the constant-current drive circuit includes voltage generation means for generating a pulse-shape voltage from a power supply voltage supplied, the pulse-shape voltage being applied to the element; current detection means for detecting a current passed through the element when the pulse-shape voltage is applied; and voltage control means for controlling start and stop of intermittent application of a voltage to the element from the voltage generation means according to the current detected by the current detection means.

According to the invention, the voltage generated from the supplied power supply voltage is periodically applied in the pulse shape to the element, and start and stop of voltage application is controlled while the current passed through the element is monitored. Therefore, the application of the voltage to the element can be controlled to maintain the current passed through the element at a predetermined current which is of a target value.

These and other objects, features, aspects and advantages of the present invention will become more apparent from the following detailed description of the present invention when taken in conjunction with the accompanying drawings.

DESCRIPTION OF THE PREFERRED EMBODIMENTS (Configuration of Constant-Current Drive Circuit)

Figure 1:
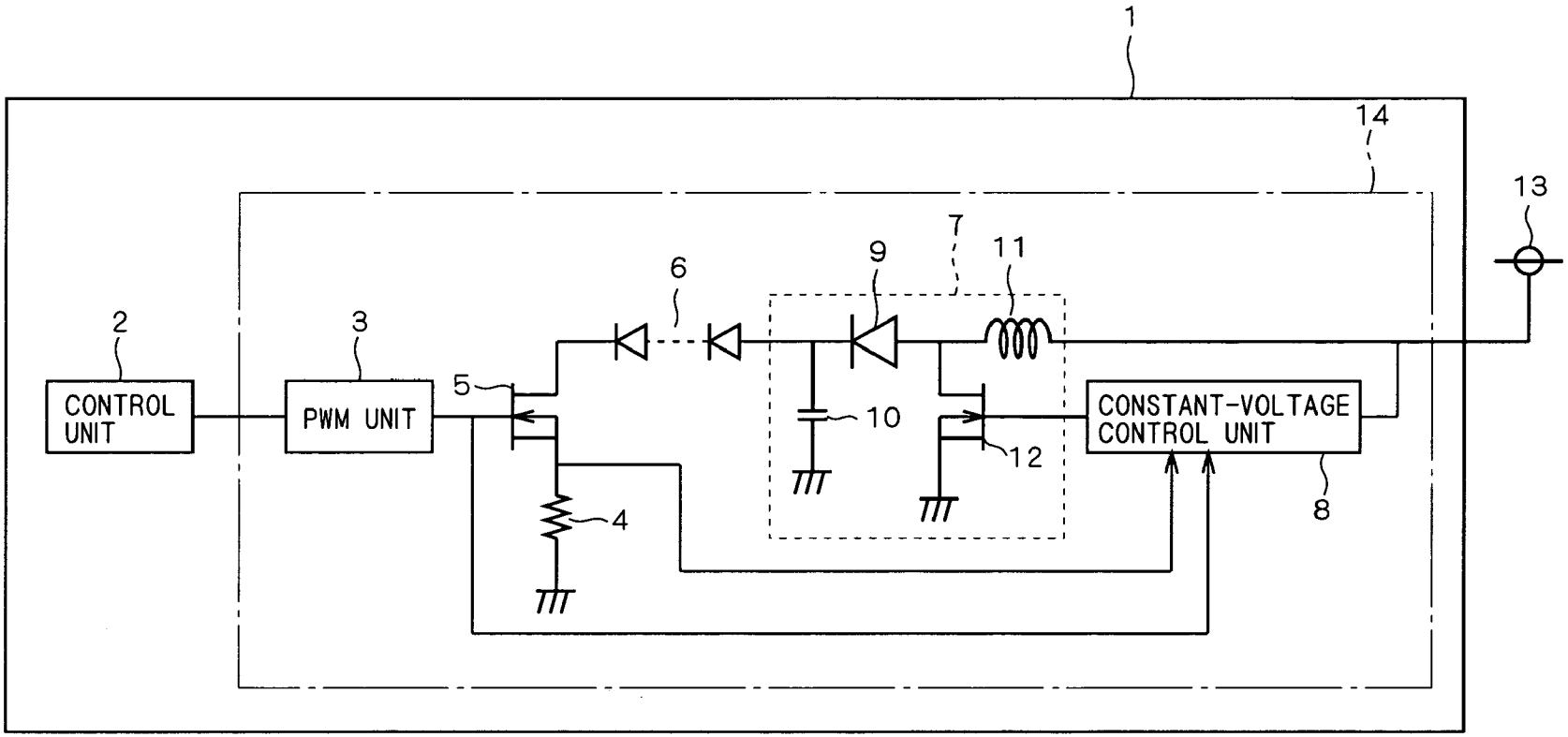
FIG. 1 shows a configuration of a constant-current drive circuit according to an embodiment of the invention.

FIG. 1 shows a configuration of a constant-current drive circuit 1 according to an embodiment of the invention. Referring to FIG. 1, the constant-current drive circuit 1 includes a boosting circuit unit 7 connected to a power supply 13, an LED group 6 connected to the boosting circuit unit 7, a switching FET 5 whose drain is connected to the LED group 6, a PWM unit 3 connected to a gate of the switching FET 5, a resistor 4 connected to a source of the switching FET 5, a control unit 2 connected to the PWM unit 3, and a constant-voltage control unit 8. The constant-voltage control unit 8 is connected to the PWM unit 3, a source of the switching FET 5, the boosting circuit unit 7, and the power supply 13. The boosting circuit unit 7 includes a coil 11 connected to the power supply 13, a rectifier diode 9 connected to the coil 11, a capacitor 10 connected to the rectifier diode 9, and a switching FET 12. The drain and gate of the switching FET 12 are connected to the coil 11 and the constant-voltage control unit 8 respectively.

The power supply 13 has a power supply voltage, and a direct-current voltage for driving the LED group 6 is obtained from the power supply voltage. The power supply voltage has a voltage value with which no breakdown is generated in the element such as the LED group 6 even if the power supply voltage is directly applied to the element.

Figure 2:
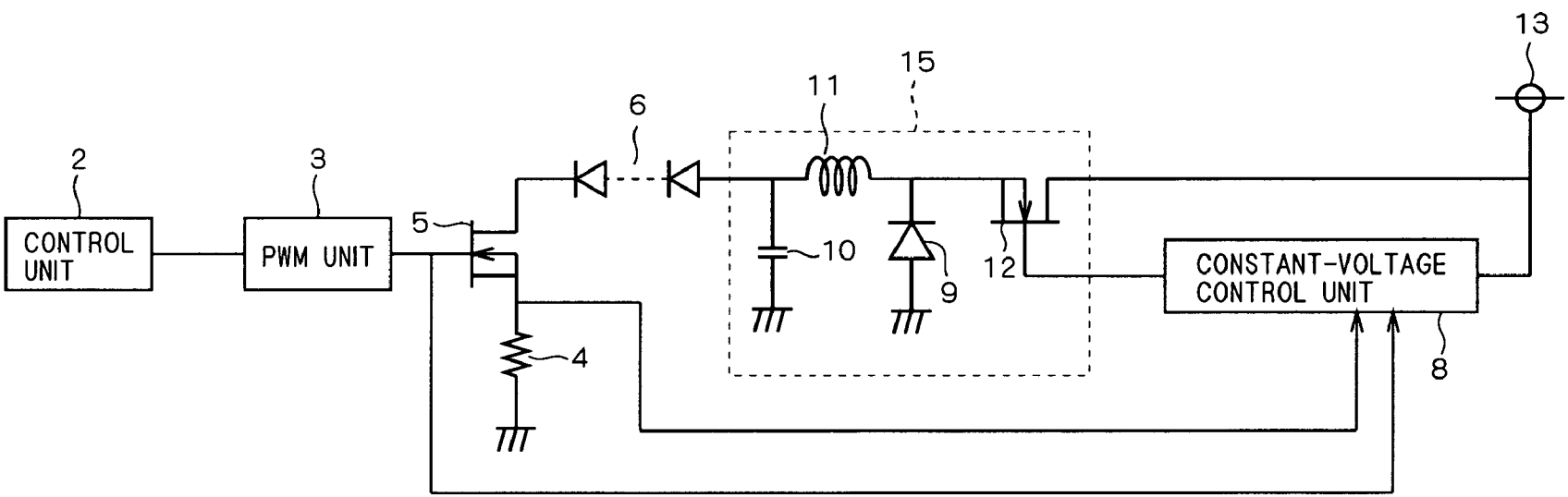
FIG. 2 shows another configuration of a boosting circuit unit according to an embodiment of the invention.

The boosting circuit unit (voltage generation means) 7 has a function of boosting the power supply voltage, supplied from the power supply 13, to generate the direct-current voltage necessary to drive the LED group 6. The boosting circuit unit 7 includes the coil 7 and switching FET 12 therein, and the boosting circuit unit 7 obtains the boosted pulse-shape direct-current voltage by utilizing an induction voltage which is generated in the coil 7 by the switching operation of the switching FET 12. The switching FET 12, as mentioned later, is also used to control the application of the generated direct-current voltage to the LED group 6. The rectifier diode 9 and the capacitor 10 are elements which generates a predetermined stable direct-current voltage. The boosting circuit unit 7 is not limited to the mode shown in FIG. 1, but any mode may be used as long as the boosting circuit unit has both the function of boosting the supplied voltage to generate the predetermined direct-current voltage and the function of controlling application of the direct-current voltage. For example, a boosting circuit unit 15 having a configuration shown in FIG. 2 may be used.

Thus, using the power supply 13 having the voltage value with which no breakdown is generated in the element such as the LED group 6 even if the power supply voltage is directly applied to the element, the constant-current drive circuit 1 can be operated by the boosting circuit unit 7, and the problem that the excessive current is passed through to break the component can also be avoided even if the malfunction is generated in the constant-current drive circuit 1. No element is broken even if the boosting circuit unit 7 is broken. Even if the switching FET 5 is broken to generate a short circuit between the drain and the source, the current is only continuously passed through LED, and the LED group 6 is never broken because the current value is controlled by utilizing the resistor 4 as described later. As described later, the resistor 4 is used to control the application of the voltage to the LED group 6. Because the breakdown of the resistor 4 can easily be confirmed by utilizing the element such as a fuse, the breakdown of the resistor 4 never leads to the breakdown of another element or the malfunction of the constant-current drive circuit 1.

As long as the constant-current drive circuit 1 is an element which dives the LED group 6 at constant current, for example, the plural LEDs having the same color may be used by connecting LEDs in series, and the plural LEDs having the colors mixed at a predetermined ratio may be used by connecting LEDs in series. In the LED group 6, the number of LEDs is not limited. For example, only one LED may be used. The embodiment may be applied to not only light emitting devices such as LED but also other elements.

The switching FET 5 has a function of periodically performing pulse-shape on-and-off control of the drain-to-source current according to a pulse voltage applied to the gate from the PWM unit 3. Specifically, when the pulse voltage is switched to an on state, the switching FET 5 switches the switching operation to the on state between the drain and the source to pass the current, which lights the LED group 6 on. When the pulse voltage is switched to an off state, the switching FET 5 switches the switching operation to the off state to cut off the current, which turns the LED group 6 off.

The PWM unit 3 has a function of generating the pulse voltage to apply a gate voltage to the switching FET 5 according to the control of the control unit 2.

The control unit 2 has a function of controlling the pulse voltage generated by the PWM unit 3. Specifically, the control unit 2 controls a duty ratio of the pulse waveform generated by the PWM unit 3. The control unit 2 and the PWM unit 3 constitute the PWM control means.

The operations of the control unit 2, PWM unit 3, and switching FET 5 control the lighting operation of the LED group 6 and the brightness of the LED group 6 during the light emission. Specifically, the PWM unit 3 generates the pulse voltage whose duty ratio is controlled by the control unit 2, and the pulse voltage is applied as the gate voltage of the switching FET 5, which performs the on-and-off control of the ground on the cathode side of the LED group 6 to light on and off the LED group 6. The LED group 6 is continuously lit on when the duty ratio is 100%, and the LED group 6 stays off when the duty ratio is 0. A ratio between an on time and an off time of the LED group 6 and the numbers of on times and off times are changed by changing the duty ratio, which allows the brightness of the LED group 6 to be controlled.

Additionally, the resistor 4 and the constant-voltage control unit 8 are provided in the constant-current drive circuit 1 to control to keep the current value passed through the LED group 6 constant, when the LED group 6 is lit on by the control unit 2 and the PWM control unit 3.

The resistor 4 is provided to detect the current passed through the LED group 6, and the current value can be obtained by a potential difference between both ends of the resistor 4 and the resistance value of the resistor 4. However, actually the current is not utilized in terms of the current value, but the potential difference between both ends of the resistor 4 is directly utilized, and how large the current is passed through the LED group 6 is measured according to the voltage value at the resistor 4.

The constant-voltage control unit (voltage control means) 8 has two functions. That is, the constant-voltage control unit 8 controls the switching operation of the switching FET 12 in order to obtain the pulse-shape direct-current voltage in which the power supply voltage is boosted by the boosting circuit unit 7, and the constant-voltage control unit 8 detects the current passed through the LED group 6 from the potential difference between both ends of the resistor 4 and controls the voltage applied to the LED group 6 from the boosting circuit unit 7 such that the current becomes a predetermined target current value. Although the operation of the constant-voltage control unit 8 will be described in detail later, a configuration example for realizing the constant-voltage control unit 8 will be described below with reference to FIG. 3.

Figure 3:
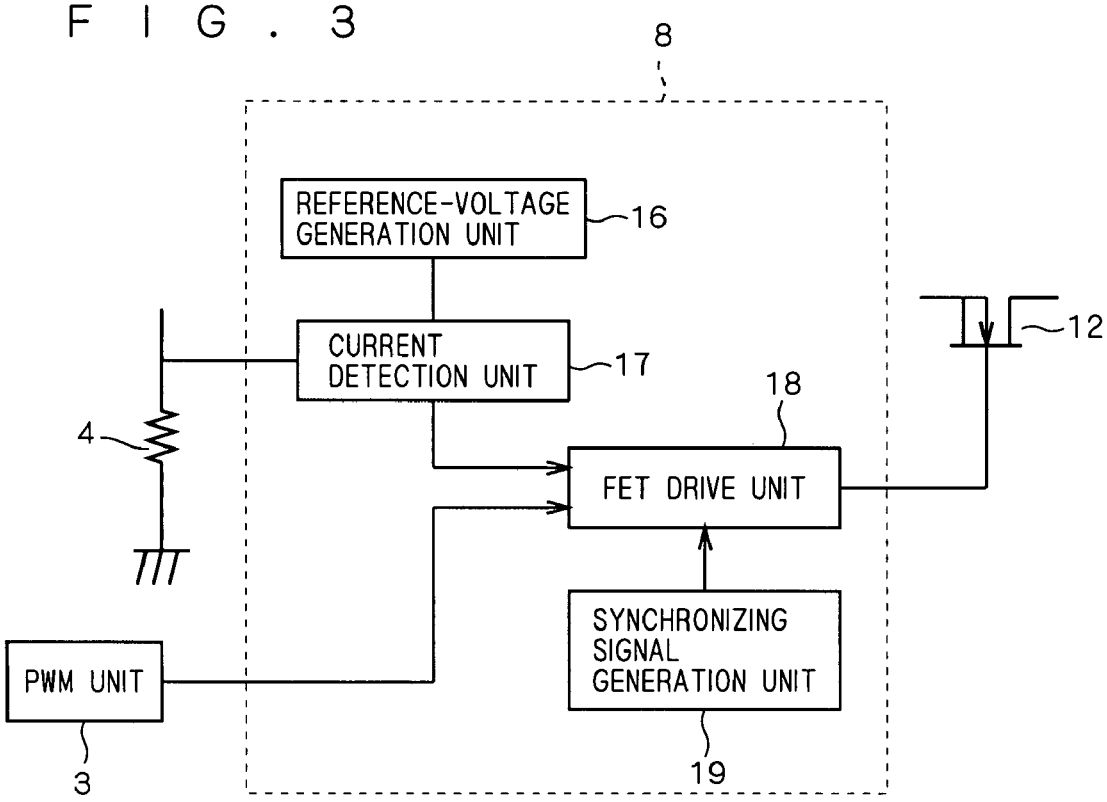
FIG. 3 shows a configuration of a constant-voltage control unit according to an embodiment of the invention.

As shown in FIG. 3, the constant-voltage control unit 8 includes a current detection unit 17 connected to the resistor 4, a reference-voltage generation unit 16 connected to the current detection unit 17, an FET drive unit 18, and a synchronizing signal generation unit 19 connected to the FET drive unit 18. The FET drive unit 18 is connected to the current detection unit 17, the switching FET 12 in the boosting circuit 7, and the PWM unit 3.

The reference-voltage generation unit 16 has a function of generating a potential difference as a reference voltage, which is generated between both ends of the resistor 4 when the constant-current drive circuit 1 drives the LED group 6 with a predetermined constant current of the target value. The potential difference generated by the reference-voltage generation unit 16 is used to compare the potential difference to the potential difference actually generated between both ends of the resistor 4. The voltage value which becomes the reference voltage may previously be fixed to a predetermined value, or the voltage value may be changeable according to the element such as the LED group 6.

As described above, the current detection unit 17 is a functional unit which detects the current passed through the LED group 6 from the potential difference between both ends of the resistor 4. Actually the current value is not directly detected, but the potential difference is detected between both ends of the resistor 4 to compare the potential difference to the reference voltage generated by the reference-voltage generation unit 16, and a determination whether the current passed through the LED group 6 is smaller or larger than the predetermined current of the target value in the constant-current drive circuit 1 is made from the comparison result. The current detection unit 17 has a function of notifying the FET drive unit 18 of the determination result.

The FET drive unit 18 has a function of controlling the switching operation of the switching FET 12 in the boosting circuit unit 7 from both the determination result of which the current detection unit 17 notifies the FET drive unit 18 and information on the pulse voltage which is obtained from the PWM unit 3 to control the switching operation of the switching FET 5. Specifically, the FET drive unit 18 controls start and stop of the application of the voltage generated by the boosting circuit unit 7 to the LED group 6 according to the pulse voltage generated by the PWM unit 3. Furthermore, the FET drive unit 18 obtains information on the current actually passed through the LED group 6, and the FET drive unit 18 performs feedback to the control of the application of the voltage to the LED group 6, which allows the controls of the voltage applied to the LED group 6. This enables the control of the current passed through the LED group 6.

The synchronizing signal generation unit 19 has a function of generating a pulse waveform as a synchronizing signal. The pulse waveform has a sufficiently higher frequency compared with the pulse voltage which is generated by the PWM unit 3 to control the switching operation of the switching FET 5. Using the synchronizing signal, the FET drive unit 18 controls the switching operation of the switching FET 12 at high speed. Therefore, the boosting circuit unit 7 generated the boosted pulse-shape direct-current voltage, and the FET drive unit 18 can control the application of the direct-current voltage to the LED group 6 at extremely higher speed compared with the control operation of the control unit 2 to the lighting and brightness of the LED group 6.

In the later-mentioned operation of the constant-current drive circuit 1, the constant-voltage control unit 8 is described as one control unit. However, actually the operation of the constant-voltage control unit 8 is realized by the functions and operations of the above-described units.

Figure 4:
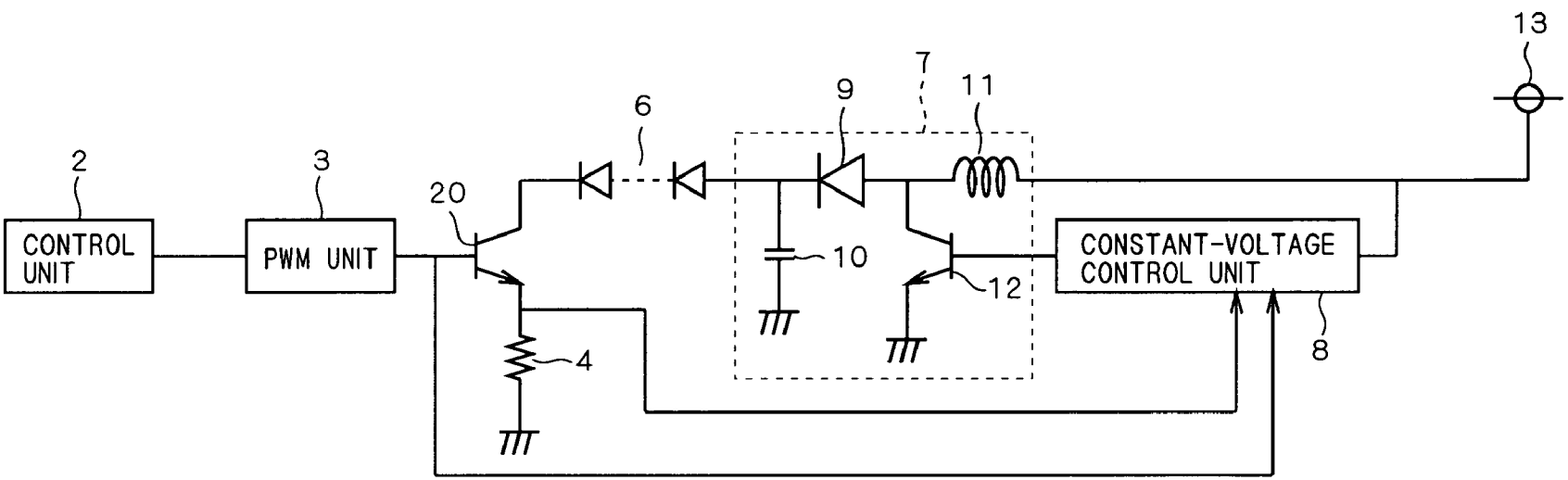
FIG. 4 shows a configuration when a constant-voltage control unit according to an embodiment of the invention is implemented by utilizing transistors.

In FIG. 1, the switching FETs 5 and 12 are used as the switching operations of the LED group 6 and boosting circuit unit 7. However, the invention is not limited to the mode shown in FIG. 1. The invention can be applied to any mode as long as the on and off of the current can be controlled by a control signal such as the gate voltage. For example, as shown in FIG. 4, transistors 20 and 21 may be used in place of the switching FETs 5 and 12.

Figure 5:
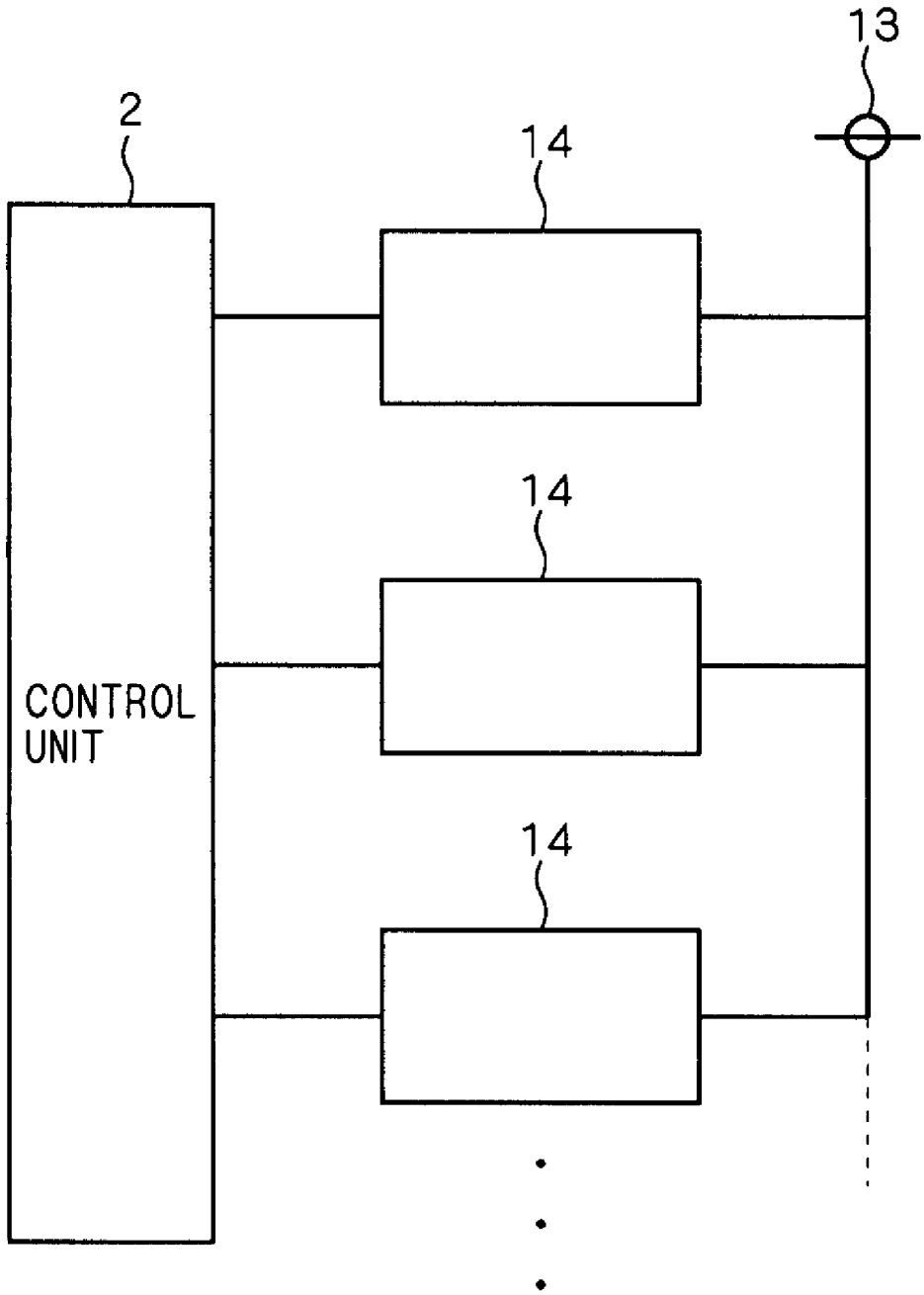
FIG. 5 shows a configuration when constant-voltage control units according to an embodiment of the invention are utilized while connected in parallel.

Although the one constant-current drive circuit 1 is shown in FIG. 1, actually the plural constant-current drive circuits 1 are often operated to drive LEDs having the colors. In such cases, in addition to the mode in which the plural constant-current drive circuits 1 are independently operated, the mode shown in FIG. 5 may be used. In the mode of FIG. 5, the control unit 2 is commonly used while groups 14 of other elements shown in FIG. 1 are connected in parallel between the control unit 2 and the power supply 13.

Then, the operation of the constant-current drive circuit 1 will be described with reference to FIG. 1.

(Operation of Constant-Current Drive Circuit)

Figures 6A, 6B, 6C, 6D, 6E:
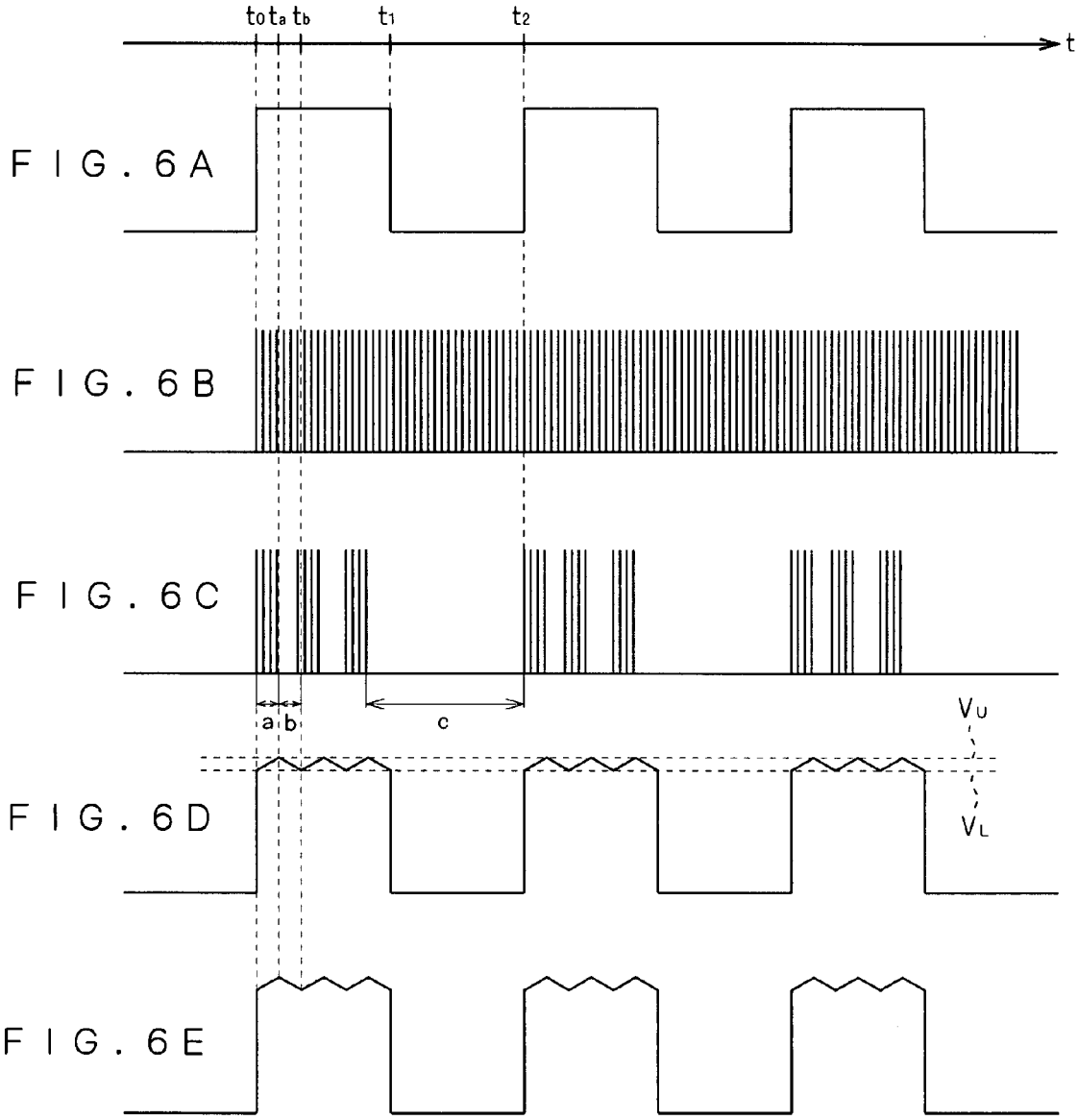
FIGS. 6A to 6E are views for explaining an operation of a constant-voltage control unit according to an embodiment of the invention.

In order to light the LED group 6 on with predetermined brightness, it is assumed that the control unit 2 causes the PWM unit 3 to generate a pulse voltage of FIG. 6A to control the switching FET 5. As shown in an upper part of FIG. 6A, a horizontal axis indicates time. In FIG. 6A, the pulse voltage generated by the PWM unit 3 remains in an on state between time $t_0$ and time $t_1$, and the pulse voltage remains in an off state between the time $t_1$ and time $t_2$.

Ideally it is necessary that the LED group 6 be lit on while the current passed through the LED group 6 exhibits the completely same waveform as that of FIG. 6A. However, conventionally, as described above, due to the influence of the charge remaining in the circuit, sometimes the rounding in which the current of zero at the time $t_0$ is gradually increased is generated in the current waveform, or sometimes the phenomenon in which the inrush current excessively exceeding the predetermined current of the target value flows at the time $t_0$ is generated. Therefore, in the constant-current drive circuit 1, using the control unit 2, PWM unit 3, and switching FET 5, the lighting operation of the LED group 6 is controlled as shown in FIG. 6A, and the current passed through the LED group 6 is finely controlled while the LED group 6 is lit on between the time $t_0$ and time $t_1$.

As shown in FIG. 6B, the pulse wave having the sufficiently higher frequency than that of the pulse waveform of FIG. 6A generated by the PWM unit 3 is generated in the constant-voltage control unit 8. The constant-voltage control unit 8 controls the switching operation of the switching FET 12 in the boosting circuit unit 7 based on the pulse waveform generated by the constant-voltage control unit 8. This enables the constant-voltage control unit 8 to cause the boosting circuit unit 7 to generate the pulse-shape direct-current voltage exhibiting the same waveform as that of FIG. 6B.

When the pulse waveform of the voltage generated by the PWM unit 3 is switched to the on position at the time $t_0$, the constant-voltage control unit 8 which receives the pulse waveform switched to the on position controls the switching FET 12 in the boosting circuit unit 7 to start the application of the direct-current voltage to the LED group 6. The direct-current voltage applied at that time is one in which the voltage supplied from the power supply unit 13 is boosted by the boosting circuit unit 7. Because the voltage actually applied to the LED group 6 can be controlled as described later by periodically applying the boosted pulse-shape voltage, the boosted voltage may have the voltage value slightly higher than the voltage value, which is required for the LED group 6 when the LED group 6 is operated at a predetermined constant current of the target value.

FIG. 6C shows the direct-current voltage applied to the LED group 6 by the boosting circuit unit 7. The constant-voltage control unit 8 controls the switching FET 12 to apply the boosted pulse-shape direct-current voltage having the same waveform as that of FIG. 6B to the LED group 6.

The constant-voltage control unit 8 compares and monitors a reference voltage $V_0$ and the potential difference. The reference voltage $V_0$ is generated at both ends of the resistor 4 when the current passed through the LED group 6 becomes equal to the target current value of the constant-current drive circuit 1, and the potential difference is actually measured at both ends of the resistor 4. FIG. 6D shows a waveform of a voltage value which is of a potential difference between both ends of the resistor 4 at that time. As shown in FIG. 6D, the voltage is $V_L$ at the time $t_0$, the voltage is gradually increased as time advances. As shown in FIG. 6C, when the voltage reaches the reference voltage $V_0$, the constant-voltage control unit 8 controls the switching FET 12 to stop the application of the voltage to the LED group 6 from the boosting circuit unit 7. However, due to a temporal operating limit and the like, actually the increase in voltage is stopped while the voltage exceeds the reference voltage $V_0$ to reach $V_U$ not at the moment that the voltage reaches $V_0$ but at time $t_a$ at which time a elapses since the time $t_0$. Then, the voltage is gradually decreased. As shown in FIG. 6C, when the voltage reaches the reference voltage $V_0$, the constant-voltage control unit 8 controls the switching FET 12 to start the application of the voltage to the LED group 6 from the boosting circuit unit 7 again. In this case, as shown in FIG. 6D, the voltage reaches $V_L$ lower than the reference voltage $V_0$ at time $t_b$ at which time b elapses since the time $t_a$, and then the voltage is increased again. However, because each element is actually operated at extremely high speed, there is a very small time difference between the time at which the voltage application is started or stopped and the time at which the voltage reaches $V_L$ or $V_U$, and there is also the very small potential difference between the reference voltage $V_0$ and $V_U$ or $V_L$. Therefore, there is no problem in the actual operation.

Thus, the constant-voltage control unit 8 periodically applies the pulse-shape direct-current voltage boosted by the boosting circuit unit 7 at extremely high frequency shown in FIG. 6B. The constant-voltage control unit 8 controls the start and stop of the application of the direct-current voltage as shown in FIG. 6C to control the voltage applied to the LED group 6. As a result, the constant-voltage control unit 8 controls the current passed through the LED group 6.

In turning the LED group 6 off at the time $t_1$ of FIG. 6A according to the pulse voltage, when only the information on the potential difference generated between both ends of the resistor 4 is used, the constant-voltage control unit 8 increases the voltage applied to the LED group 6 in accordance with the decrease in voltage. However, the constant-voltage control unit 8 also obtains the information on the pulse waveform of FIG. 6A generated by the PWM unit 3, the constant-voltage control unit 8 avoids the phenomenon, and the constant-voltage control unit 8 controls the boosting circuit unit 7 to stop the application of the voltage to the LED group 6 during time c until the pulse waveform from the PWM unit 3 is switched to the on position at the time $t_2$ as shown in FIG. 6C. The constant-voltage control unit 8 starts the voltage control as described above from the time $t_2$.

Thus, the voltage applied to the LED group 6 is finely controlled while the potential difference generated between both ends of the resistor 4, which allows the current passed through the LED group 6 to exhibit the waveform shown in FIG. 6E. As shown in FIG. 6D, because the potential difference between both ends of the resistor 4 fluctuates between the voltage $V_U$ of an upper limit and the voltage $V_L$ of a lower limit, the current passed through the LED group 6 also fluctuates the current corresponding to $V_U$ and the current corresponding to $V_L$ in accordance with the fluctuation in voltage. However, as described above, actually the fluctuation range is too small to change the brightness of the LED group 6, so that the fluctuation in voltage has no influence on the operation of the LED group 6. Accordingly, through the above operation, the constant-current drive circuit 1 can light the LED group 6 on with the brightness when the predetermined current is passed.

In accordance with the pulse waveform generated by the PWM unit 3, when the pulse waveform is switched to the off position, the operations of the constant-voltage control unit 8 and boosting circuit unit 7 are stopped and the currents passed through the LED group 6 and resistor 4 become zero. At this point, even if the boosting circuit unit 7 continuously generates the boosted pulse-shape direct-current voltage, once the lighting of the LED group 6 is started, the applied direct-current voltage is controlled in the above-described manner while the potential difference corresponding to the current passed through the LED group 6 is monitored at both ends of the resistor 4. Therefore, the problem such as the generation of the inrush current which conventionally becomes problematic can be avoided.

Because the voltage applied to the LED group 6 is controlled while applied in the pulse shape at high frequency as described above, the boosting circuit unit 7 generates the direct-current voltage slightly higher than the predetermined voltage which is required when the predetermined current is obtained in the LED group 6, and the direct-current voltage slightly higher than the predetermined voltage can be used. The direct-current voltage slightly higher than the predetermined voltage is applied to the LED group 6 while the control is performed as described above. Therefore, the sufficient current which lights on the LED group 6 with the target brightness can be obtained immediately after the LED group 6 is lit on.

Alternatively, when the pulse-shape direct-current voltage boosted by the boosting circuit unit 7 is generated while the LED group 6 is turned off, the sufficient current which lights on the LED group 6 with the target brightness can be obtained immediately after the LED group 6 is lit on, and the generation of the inrush current can also be avoided.

As described above, the constant-voltage control unit 8 detects and utilizes the potential difference between both ends of the resistor 4 which is provided to detect the current passed through the LED group 6. The charge does not remain in the resistor 4 because the resistor 4 is grounded, so that the residual charge has no influence on the potential difference. Therefore, when the LED group 6 is lit on by the control unit 2 and PWM unit 3, the constant-voltage control unit 8 can instantly and correctly obtain the voltage generated between both ends of the resistor 4, which corresponds to the current passed through the LED group 6.

Accordingly, when the LED group 6 is lit on, the current passed through the LED group 6 also exhibits the steep rise as shown in FIG. 6E according to the rise of the pulse waveform of FIG. 6A generated by the PWM unit 3, and the phenomenon such as the rounding of the current waveform in which the current is gradually increased to reach the target current can be avoided.

Because the information corresponding to the current passed through the LED group 6 is obtained and utilized from the potential difference between both ends of the resistor 4, it is not necessary to perform a task of providing the adjusting resistor based on an intrinsic value of the LED group 6 such as the forward drop voltage of the LED group 6. The change in ambient temperature of the element including the LED group 6 or a variation with time of the element can be served without making any particular adjustments.

According to the above modes, the number of LEDs which can be utilized by connecting LEDS in series is not limited. Therefore, the constant-current drive circuits 1 can be used by connecting the constant-current drive circuits 1 in parallel as shown in FIG. 5, the brightness of LED can be changed in each constant-current drive circuit 1 by adjusting the reference-voltage generation unit 16 in the constant-voltage control unit 8 shown in FIG. 3, and an apparatus in which the element such as LED is utilized in various modes can be realized.

While the invention has been shown and described in detail, the foregoing description is in all aspects illustrative and not restrictive. It is therefore understood that numerous modifications and variations can be devised without departing from the scope of the invention.

What is claimed is:

1. A constant-current drive circuit which drives an element with a predetermined current value, the constant-current drive circuit comprising:

voltage generation unit that generates a pulse-shape voltage from a power supply voltage supplied, the pulse-shape voltage being applied to said element;

a switching unit whose drain is connected to said element;

current detection unit connected to a source of said switching unit, said current detection unit detects a current passed through said element when said pulse-shape voltage is applied;

voltage control unit connected to said source of said switching unit, said voltage control unit controls start and stop of intermittent application of a voltage to said element from said voltage generation unit according to the current detected by said current detection unit; and a PWM control unit that periodically performs pulse-shape on-and-off control of an operation of said element, wherein said voltage control unit turns on and off the operation of said element upon said switching unit being turned on and off by a PWM pulse output from said PWM control unit and controls the start and stop of the intermittent application of the voltage to said element from said voltage generation unit according to a period during which said element is turned on and off.

2. A constant-current drive circuit according to claim 1, wherein a frequency of the pulse-shape voltage applied to said element by said voltage generation unit is higher than a frequency with which said PWM control unit turns on and off the operation of said element.

3. A constant-current drive circuit according to claim 1, wherein a voltage of said voltage generation unit is lower than a voltage at which said element is broken when the voltage applied to said element.

4. A constant-current drive circuit according to claim 1, wherein said element is a light emitting element.

5. A constant-current drive circuit according to claim 1, wherein said switching unit is a switching field-effect transistor (FET).

6. A constant-current drive circuit according to claim 1, wherein said switching unit is a transistor.

* * * * *